US006058660A

United States Patent [19]

Melton

[11] Patent Number: 6,058,660

[45] Date of Patent: May 9, 2000

[54] PORTABLE GARAGE

[76] Inventor: Willie F. Melton, 2035 Idlewood Rd., Bldg. P #6, Tucker, Ga. 30084

[21] Appl. No.: 09/131,531

[22] Filed: Aug. 10, 1998

[51] Int. Cl.[7] ..... E04B 1/346

[52] U.S. Cl. ..... 52/71; 52/79.5; 52/36.4; 52/36.5; 411/281; 411/282.3; 411/284

[58] Field of Search ..... 52/71, 79.5, 36.4, 52/36.5; 411/281, 282.3, 284

[56] References Cited

U.S. PATENT DOCUMENTS

| | | | |
|---|---|---|---|
| 4,696,132 | 9/1987 | LeBlanc | 52/69 |
| 4,986,037 | 1/1991 | Jackson, Jr. . | |
| 4,991,363 | 2/1991 | Randmae . | |
| 5,216,850 | 6/1993 | Kemper . | |
| 5,293,725 | 3/1994 | Matticks et al. | 52/271 |
| 5,331,777 | 7/1994 | Chi-Yuan . | |
| 5,369,920 | 12/1994 | Taylor . | |
| 5,570,544 | 11/1996 | Hal . | |
| 5,794,385 | 8/1998 | Donovan | 52/36.4 |

*Primary Examiner*—Christopher T. Kent
*Assistant Examiner*—Nkeisha J. Maddox
*Attorney, Agent, or Firm*—Kenneth L. Tolar

[57] ABSTRACT

A portable garage assembly includes a floor member formed of three foldable sections having a plurality of peripherally disposed indentions on its upper surface. Received within its indentions are vertical support members that are secured thereto with quick release screws. A side, a rear and a front wall are removably secured to the support members. A plurality of directional and transverse beams are secured to the top ends of the support members for supporting a multi-section, laterally sloping roof. An opening on the front panel defines an entrance. The entrance is selectively enclosable with a garage door movable along a pair of tracks between a vertical, closed position and a horizontal open position. The device is designed to be quickly and easily erected or alternatively disassembled for transport or storage.

16 Claims, 2 Drawing Sheets

PORTABLE GARAGE

BACKGROUND OF THE INVENTION

The present invention relates to a portable garage assembly which may be easily disassembled for transport or storage.

DESCRIPTION OF THE PRIOR ART

Persons who inhabit apartments and similar dwellings that typically have no carport or garage must continuously subject their vehicles to external elements such as hail, intense sunlight, debris and vandals. Furthermore, homeowners who have limited storage space often erect a storage shed or similar structure to store various tools and other items therein. Such storage sheds are generally permanent and are often erected on a concrete foundation. However, if the user subsequently moves to another location, the device cannot be practically disassembled and transported. Therefore, the shed must remain with the dwelling.

Accordingly, there is currently a need for a portable storage device capable of enclosing and protecting a vehicle which may be easily disassembled and transported. The present invention satisfies the above described needs by providing a storage shed/portable garage having a rigid structural integrity and which may be quickly and easily erected or disassembled for transport or storage.

Although various portable enclosures exist in the prior art, none have the unique features and advantages of the present invention. For example, U.S. Pat. No. 5,570,544 issued to Hale et al relates to a support structure for tents and similar coverings including a plurality of inflatable, air supported frame members. The configuration of the frame structure may be altered as desired.

U.S. Pat. No. 5,369,920 issued to Taylor relates to a motorcycle garage comprising a floor member having a roof portion partially covering the floor portion. The device further includes a side wall, front gate and lid all of which are pivotable to facilitate access to the interior.

U.S. Pat. No. 5,331,777 issued to Chi-Yuan relates to a collapsible folding frame assembly including two collapsible folding frame units vertically disposed at two opposite sides and a bridge frame unit connected between the two folding units. The collapsible frame assembly supports a vehicle barn.

U.S. Pat. No. 5,216,850 issued to Kemper et al. relates to aportable garage including flexible panel webs secured to a carport structure having a plurality of support posts with a roof mounted thereon.

U.S. Pat. No. 4,991,363 issued to Randmae relates to a portable, air supported protective enclosure for a vehicle comprising a flexible sheeting dimensioned to receive and surround a vehicle.

U.S. Pat. No. 4,986,037 issued to Jackson, Jr. relates to a collapsible shed for a vehicle including a fixed enclosure anchored to the ground having an open front and a telescoping enclosure mounted thereto for selectively extending the length of the enclosure.

Although various portable or collapsible enclosures for vehicles exist in the prior art, none relate to a portable enclosure according to the present invention. The present invention includes a portable, foldable floor assembly with vertical supports removably mountable thereon. A sectionable wall and roof may be secured to the supports to form a portable enclosure. Furthermore, a front panel contains an entrance for a vehicle which is selectively closeable with a track-mounted garage door.

SUMMARY OF THE INVENTION

The present invention relates to a portable garage structure including a substantially rectangular floor member comprised of three sections, each hinged to the adjacent section allowing the floor member to be compactly folded for storage. The floor member has a plurality of peripheral indentions thereon sized and dimensioned to receive a vertical support member. On the side edges of the floor member are apertures for receiving quick release screws to secure the vertical support member within their respective indentions. Bordering the side walls and transverse thereto are beam members resting on the top ends of the support members for supporting a roof portion. Side, front and rear walls are secured to the support members to form an enclosure. The roof portion includes three detachable sections each having a lip on each of two opposing side edges thereof. The first and second lips have differing thicknesses so that the sections laterally slope when placed on the opposing side walls. The front wall contains an entrance sized to receive a vehicle that is selectively closable with a garage type door that moves up and down along a pair of L-shaped tracks. It is therefore an object of the present invention to provide a portable garage that may be quickly and easily erected or disassembled.

It is yet another object of the present invention to provide a portable garage structure having a garage type door thereon.

It is yet another object of the present invention to provide a portable garage structure having a rigid structural integrity.

Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
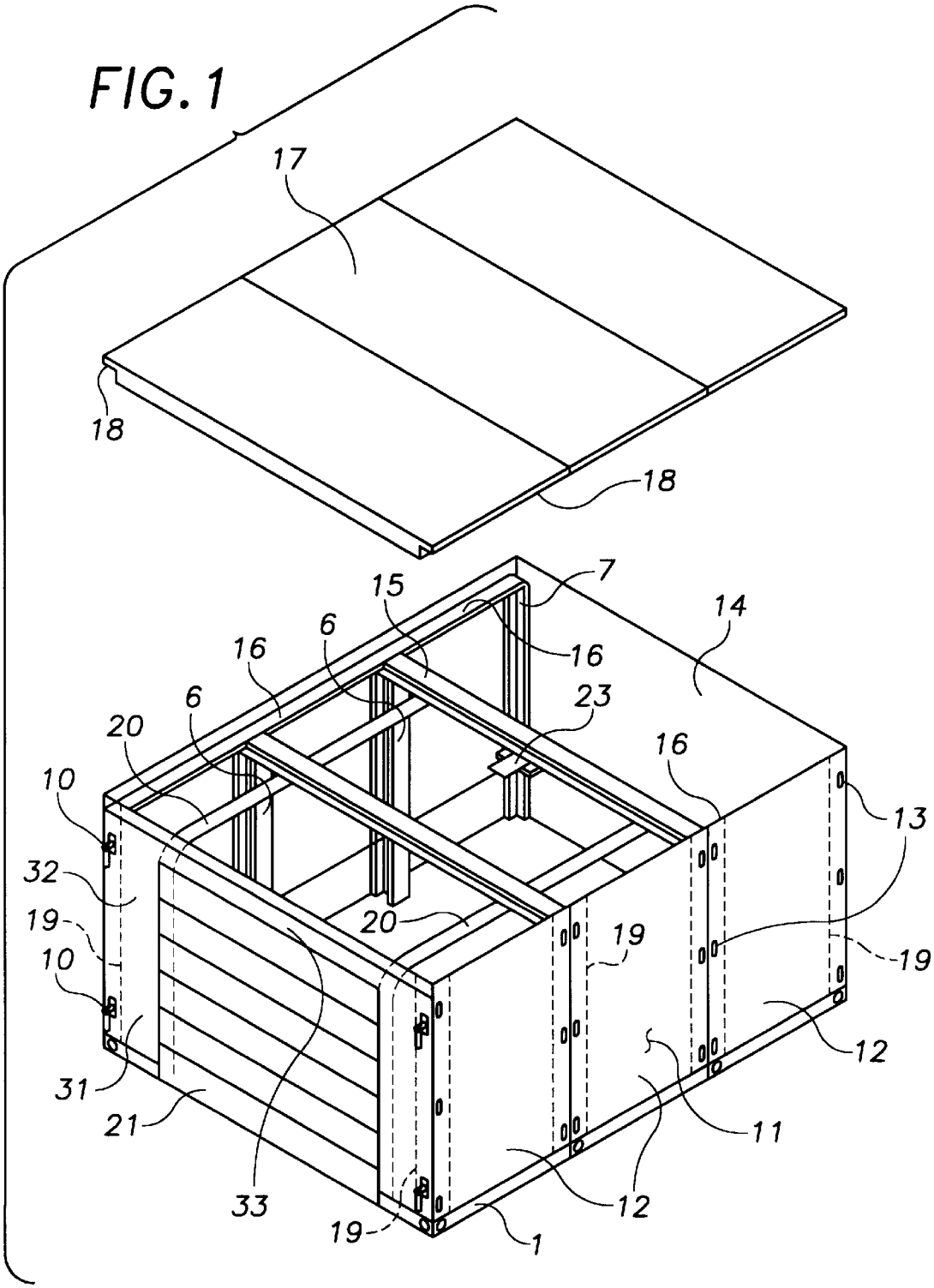
FIG. 1 is a perspective view of the inventive device with the roof portion offset therefrom.
Figure 2:
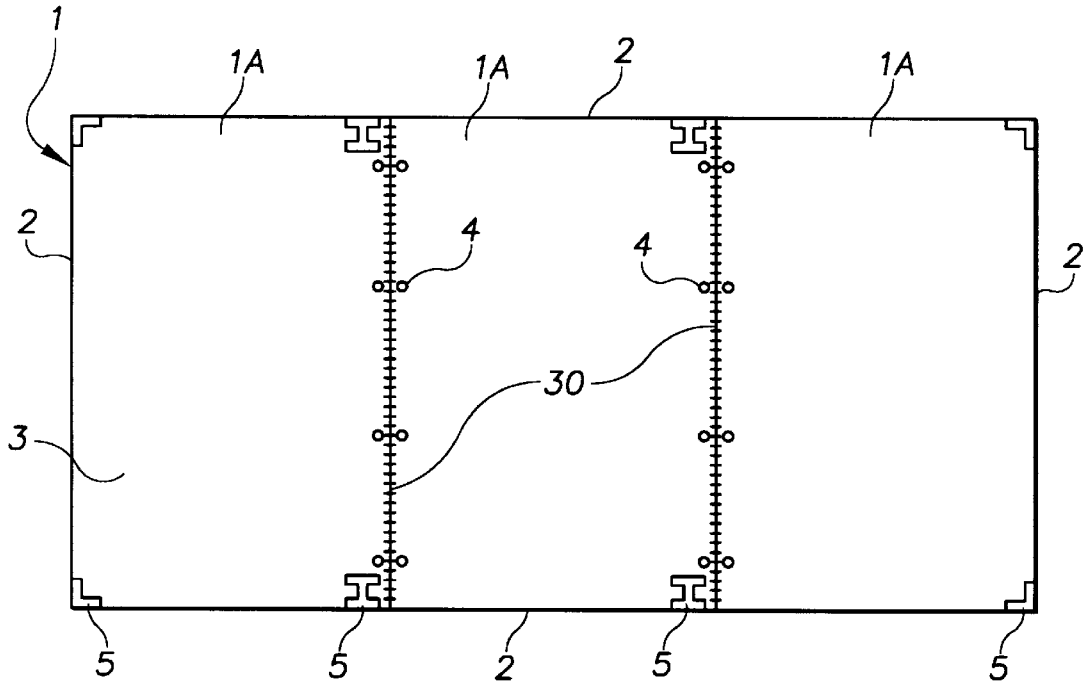
FIG. 2 is a top view of the floor member.
Figure 3:
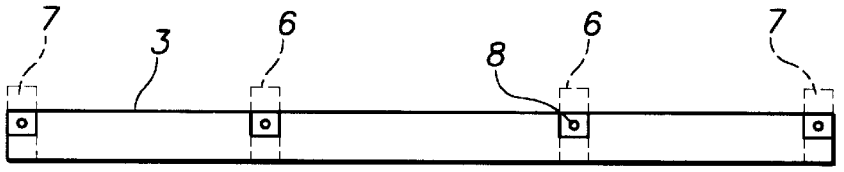
FIG. 3 is a side view of the floor member.
Figure 4:
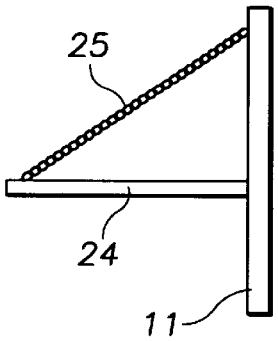
FIG. 4 depicts the work table according to the present.

Referring now to FIGS. 1 through 4, the present invention relates to portable garage assembly. The device comprises a substantially rectangular, planar floor member 1 having four peripheral edges 2, a lower surface and an upper surface 3. The floor member is formed of three hinged sections 1A allowing the floor to be compactly folded for storage. Each section has a plurality of apertures 4 adjacent each hinge 30 to receive an anchoring means to secure the floor to an underlying support surface if desired. On the upper surface of the floor member adjacent each side edge are a plurality of indentions 5 configured and dimensioned to receive a distal end of a vertical support member. The intermediately disposed support members 6 preferably have a substantially H-shaped cross-sectional configuration whereas the corner supports 7 have a substantially L-shaped cross-sectional configuration. Each support member has one or more apertures adjacent its bottom end which align with apertures 8 on the floor side edge when the support is inserted into an indention. A conventional, quick release screw 10 is inserted into the aligned apertures to secure the support member to the floor.

The device also includes a pair of opposing side walls 11 securable to the vertical support members. Each side wall is formed of a plurality of separate panels 12 which facilitate in the assembly, disassembly, transporting and storage of the device. Each panel has a plurality of vertically aligned, spaced apertures 13 along each of two opposing side edges thereof which are aligned with vertically aligned apertures on a respective support member to receive a quick release screw.

A unitary rear wall 14 is securable to two L-shaped corner support members in a similar manner. Disposed between the front ends of each side wall is a front wall 31 including a pair of opposing side panels 32 with an upper portion 33 therebetween. The space between the side panels and the upper portion defines an entrance dimensioned to receive a vehicle.

Extending from a top edge of each H-shaped support member to the similarly positioned support member adjacent the opposing side wall is a horizontal transverse H-shaped beam 15. A horizontal L-shaped beam 16 extends along the top edge of each side wall and rests on the upper surface of each transverse beam. Each L-shaped beam is preferably formed from three sections to facilitate transport and storage.

A roof portion 17 is supportable on the beams and includes three separable rectangular sections, each having two longitudinal and two latitudinal side edges. At each latitudinal side edge is an outwardly extending lip 18 that abuts the top edge of a side wall. A first lip has a differing thickness than the opposing lip so that the roof slopes laterally to promote drainage. Preferably, the joints formed by the adjoining wall panels including the corner joints are covered with a molding strip 19 as depicted in phantom in FIG. 1 to provide a water tight seal therebetween.

A pair of parallel, substantially L-shaped track members 20 extend upwardly adjacent opposing sides of the entrance and then horizontally immediately beneath a pair of transverse beams and are secured thereto. A garage door 21 is provided for selectively closing the entrance. The door has a plurality of wheels on each of two opposing sides thereof which are received within the L-shaped tracks 20. Accordingly, the door is movable between a vertical, closed position where the door is disposed within the entrance and a horizontal, open position where it is disposed immediately beneath the transverse beams. A remotely operable actuating means 23 such as a conventional garage door opener may be attached to a transverse beam and the garage door for remotely moving the door between its two positions.

Figure 5:
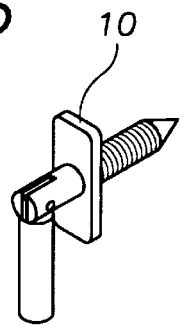
FIG. 5 depicts a quick release screw according to the present invention.

Referring now to FIG. 5, a work table 24 may also be provided a side of which hingedly engages the inner surface of a side wall. The work table is pivotable between a horizontal and vertical position and is supported in a horizontal position with a pair of chains 25, each attached to an opposing side of the table.

The walls and roof portion are preferably constructed with fiberglass while the beams are preferably constructed with aluminum or a similar equivalent. The floor preferably is manufactured with a rubber or similar durable but flexible material. However, as will be readily apparent to those skilled in the art, the size, shape and materials of construction may be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A portable garage assembly comprising:

a planar floor member having an upper surface, a plurality of peripheral edges, and a plurality of indentions on said upper surface, each indention adjacent one of said peripheral edges;

a plurality of vertical support members each received within a designated indention;

means for securing said support members within said indentions;

a pair of opposing side walls removably attachable to a predetermined number of support members, said side walls each having a front end, a rear end and a top edge;

a rear wall attached to a plurality of support members and disposed between the rear ends of said side walls, said rear wall having a top edge;

a front wall having a top edge and an opening defining an entrance, said front wall disposed between the front ends of said side walls;

a roof portion overlaying the top edges of said side, front and rear walls;

a door movable between a closed position, disposed within said entrance, and an open position removed from said entrance;

a remotely controlled actuator means for automatically moving said door between the open and closed positions.

2. A portable garage assembly according to claim 1 wherein said roof portion includes a plurality of separable sections.

3. A portable garage assembly according to claim 2 wherein each roof section has a first lip extending from a side edge and a second lip extending from an opposing side edge, said first and second lips having different thicknesses for forming a laterally sloping roof when said sections are placed on the top edges of said side walls.

4. A portable garage assembly according to claim 1 wherein said means for securing said vertical support members within said recesses comprises a plurality of quick release screws, each screw receivable within an aperture on one of the peripheral edges of the floor member and an aligned aperture on one of the vertical support members.

5. A portable garage assembly according to claim 1 wherein said side walls each comprise a plurality of separable sections.

6. A portable garage assembly according to claim 1 further comprising a plurality of horizontal beams substantially aligned with said side walls and a plurality of horizontal beams transverse thereto for supporting said roof in a substantially horizontal position.

7. A portable garage assembly according to claim 5 wherein said side wall sections are secured to a select number of vertical support members with quick release screws.

8. A portable garage assembly according to claim 1 wherein said door includes a plurality of wheels on each of two opposing sides which are received within a pair of opposing substantially L-shaped tracks extending vertically along opposing sides of the entrance and horizontally immediately beneath the transverse beams so that said door is vertically disposed within said entrance in a closed position and is slidable to a horizontal, open position immediately beneath said beams.

9. A portable garage assembly according to claim 1 wherein said front and rear walls are secured to said support members with quick release screws.

10. A portable garage assembly according to claim 1 wherein said floor member comprises a plurality of independently foldable sections allowing said floor member to be compactly folded for storage.

11. A portable garage assembly according to claim 1 further comprising a work table having a first side edge hingedly attached to a side wall, said work table pivotable between a horizontal and vertical position.

12. A portable garage assembly according to claim 11 wherein said work table includes a pair of chains, each having first and second ends, the first of which is attached to a side edge of said table, the second end attached to said side wall for supporting said work table in a horizontal position.

13. A portable garage assembly according to claim 5 wherein each pair of adjacent wall sections forms a joint therebetween having a molding strip overlaying said joint to provide a water tight seal.

14. A portable garage assembly according to claim 1 wherein said side, front and rear walls form four corners each of which has a molding strip thereover to provide a water tight seal.

15. A portable garage assembly comprising:

a planar floor member having an upper surface and a plurality of peripheral edges, said floor member having a plurality of indentions on the upper surface thereof, each indention adjacent one of said peripheral edges;

a plurality of vertical support members each received within a designated indention;

means for securing said support members within said indentions; said means including a plurality of quick release screws each receivable within an aperture on a peripheral edge of the floor member and an aligned aperture on one of said vertical support members;

a pair of opposing side walls removably attachable to a predetermined number of support members, said side walls having front and rear ends and a top edge;

a rear wall attached to a plurality of support members and disposed between the rear ends of said side walls, said rear wall having a top edge;

a front wall having an opening defining an entrance, said front wall disposed between the front ends of said side walls, said front wall having a top edge;

a roof portion overlaying the top edges of said side, front and rear walls.

16. A portable garage assembly comprising:

a planar floor member having an upper surface and a plurality of peripheral edges, said floor member having a plurality of indentions on the upper surface thereof, each indention adjacent a peripheral edge;

a plurality of vertical support members each received within a designated indention;

means for securing said support members within said indentions;

a pair of opposing side walls removably attachable to a predetermined number of support members with quick release screws, said side walls having front and rear ends and a top edge;

a rear wall attached to a plurality of support members with quick release screws and disposed between the rear ends of said side walls, said rear wall having a top edge;

a front wall having an opening defining an entrance, said front wall disposed between the front ends of said side walls, said front wall having a top edge;

a roof portion overlaying the top edges of said side, front and rear walls.

* * * * *